United States Patent [19]

Allais et al.

[11] Patent Number: 5,062,347

[45] Date of Patent: Nov. 5, 1991

[54] TRUNNION ASSEMBLY

[75] Inventors: Jean-Philippe P. B. Allais, Montivilliers; Alain R. Guillermond, Epouville; Pascal G. Rouyer, Le Havre, all of France

[73] Assignee: Societe Anonyme Dite Hispano Suiza, Saint Cloud Cedex, France

[21] Appl. No.: 561,867

[22] Filed: Aug. 2, 1990

[30] Foreign Application Priority Data

Aug. 10, 1989 [FR] France ..... 89 10764

[51] Int. Cl.[5] ..... F41A 27/08; F41A 23/10

[52] U.S. Cl. ..... 89/37.07

[58] Field of Search ..... 384/517, 518, 563; 89/37.07

[56] References Cited

U.S. PATENT DOCUMENTS

| | | | |
|---|---|---|---|
| 1,742,436 | 1/1930 | Dabrasky | 89/37.01 |
| 2,564,568 | 8/1951 | Franklin | 89/37.01 |
| 2,712,271 | 7/1955 | Wabnitz | 89/37.07 |
| 2,836,473 | 5/1958 | Tydeman | 384/563 |
| 3,726,576 | 4/1973 | Barnbrook et al. | 384/563 |
| 3,746,412 | 7/1973 | Hay | 384/563 |
| 4,727,762 | 3/1988 | Hayashi | 384/517 |

FOREIGN PATENT DOCUMENTS

| | | | |
|---|---|---|---|
| 917431 | 9/1954 | Fed. Rep. of Germany | 384/563 |
| 2192643 | 2/1974 | France . | |
| 2169361A | 7/1986 | United Kingdom . | |

*Primary Examiner*—David H. Brown

*Attorney, Agent, or Firm*—Bacon & Thomas

[57] ABSTRACT

The trunnion assembly according to the present invention has a pivot pin with a longitudinal axis defining the pivot axis of a weapon carrier with respect to a support member. A pair of pivot pins are located on either side of the weapon carrier with their longitudinal axes generally co-axial and are each mounted in the support member by a bearing enabling each of the pivot pins to readily rotate about their longitudinal axes with respect to the support members. The pivot pins, which may be supported in a mounting box attached to each of the support members, are biased in a first direction toward each other by a spring device interposed between the bearing and the mounting box. When in their most extreme biased position, the distance between them is inadequate to accommodate the insertion of the weapon carrier between them. Thus, in order to overcome the biasing force exerted on the pins in the first direction, a nut is attached to a threaded portion of the pivot pin and is prevented from disengagement from the pin via a spring clip of the like. Rotation of the nut causes it to bear against a portion of the mounting box such that further nut rotation axially moves the pin in a second direction, generally opposite to the first direction, thereby overcoming the spring biasing force and moving the pins further apart. Once in these positions, the weapons carrier may be physically inserted between the pivot pins, which then may be moved back in the first direction and be attached to the weapon carrier. Once attached, the nuts on the pivot pins are retracted away from contact with the mounting box to enable the weapons carrier to move laterally with respect to the support turret against the spring biasing forces.

14 Claims, 4 Drawing Sheets

TRUNNION ASSEMBLY

BACKGROUND OF THE INVENTION

The present invention relates to a trunnion assembly for pivotally supporting a weapons carrier on a support member, which may be part of a rotatable turret mounted on a vehicle.

It is well-known in the art to mount various types of weapons carriers on turrets attached to the roof of an armored vehicle. The weapon carrier must be pivotally supported on the turret support to enable the operator to rapidly adjust the elevational angle of the weapon prior to firing. Thus, it is necessary to have a trunnion assembly interconnecting the weapon carrier to the turret support to achieve this variable elevation.

The tunnion assembly should also be relatively lightweight to minimize the complexity and the bulkiness of the turret, and should also facilitate the assembly of the weapon carrier to the turret, if possible. When the weapon carrier is supported between a pair of parallel members on the turret, the trunnion assembly should facilitate the insertion of the weapon carrier between the parallel support members.

SUMMARY OF THE INVENTION

The trunnion assembly according to the present invention has a pivot pin with a longitudinal axis defining the pivot axis of the weapon carrier with respect to the support member. A pair of pivot pins are located on either side of the weapon carrier with their longitudinal axes generally co-axial and are each mounted in the support member by a bearing enabling each of the pivot pins to readily rotate about their longitudinal axes with respect to the support members.

The pivot pins, which may be supported in a mounting box attached to each of the support members, are biased in a first direction toward each other by a spring device interposed between the bearing and the mounting box. When in their most extreme biased positions, the distance between them is inadequate to accommodate the insertion of the weapon carrier between them. Thus, in order to overcome the biasing force exerted on the pins in the first direction, a nut is attached to a threaded portion of the pivot pin and is prevented from disengagement from the pin via a spring clip or the like. Rotation of the nut causes it to bear against a portion of the mounting box such that further nut rotation axially moves the pin in a second direction, generally opposite to the first direction, thereby overcoming the spring biasing force and moving the pins further apart.

Once in these positions, the weapons carrier may be physically inserted between the pivot pins, which then may be moved back in the first direction and be attached to the weapon carrier. Once attached, the nuts on the pivot pins are retracted away from contact with the mounting box to enable the weapons carrier to move laterally with respect to the support turret against the spring biasing forces to accomodate vibration, differential expansion, etc.

DETAILED DESCRIPTION OF THE PREFERRED EMBODIMENT

A turret incorporating the trunnion assembly according to the present invention is illustrated in FIGS. 1–4. Although the trunnion assembly will be described in conjunction with its use in this turret, it is to be understood that the trunnion assembly can be utilized to pivotally support any one member on another member.

Figure 2:
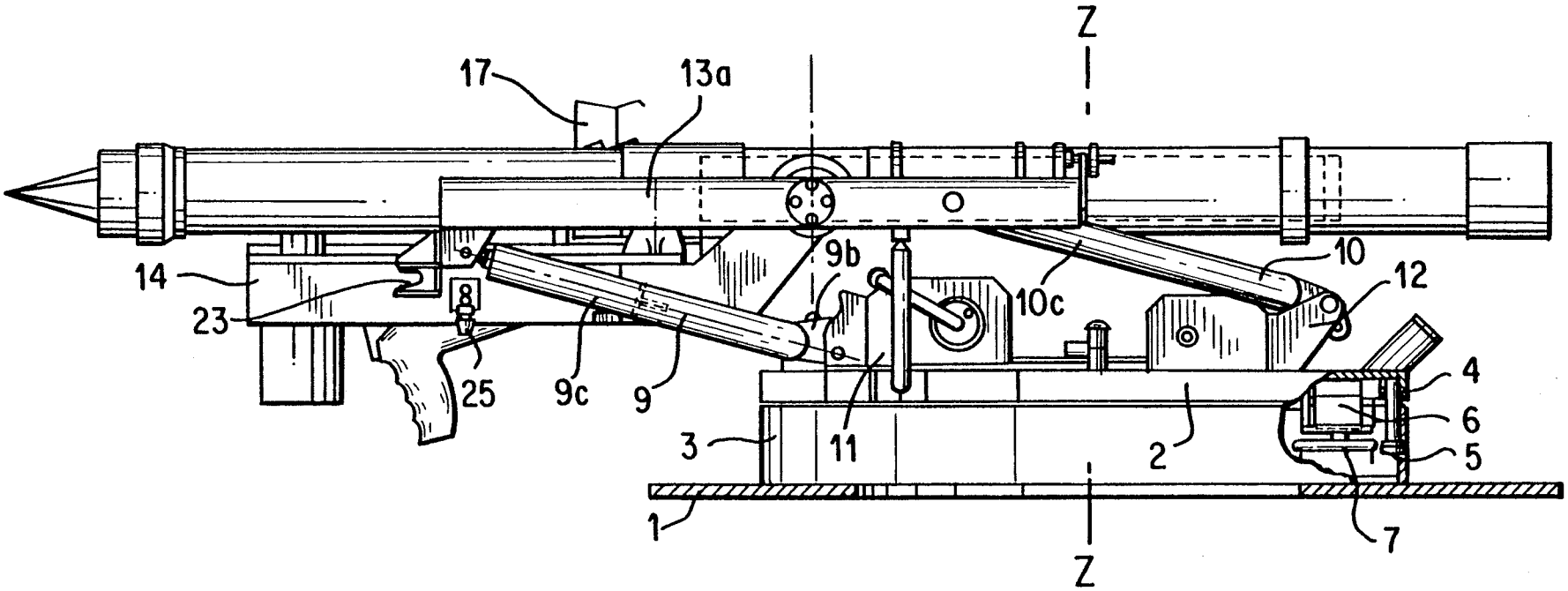
FIG. 2 is a side view of the turret shown in FIG. 1, with the turret in its stowed position.

The turret, which is illustrated as being mounted on the top of a vehicle 1 (not otherwise shown) comprises a circular support plate 2 that is rotatably attached to collar 3 so as to rotate about an aximuth axis Z—Z over 360°. As best seen in FIG. 2, a horizontal bearing structure 4 rotatably supports the support plate on the collar 3. The collar also includes a ring gear 5 with which pinion gear 7 is engaged. In known fashion, pinion gear 7 forms a part of azimuth coder 6 to indicate the azimuth direction of the position of the support plate.

Support plate 2 defines a generally centrally located opening which may be covered by a rectangular armored hatch 8. Hatch 8 may be pivotally attached to the support plate 2 so as to be movable between a closed position, illustrated in FIG. 2, and an open position, illustrated in FIG. 1. When the hatch is open, the operator may gain access to the turret through the opening defined by the support plate 2.

Figure 1:
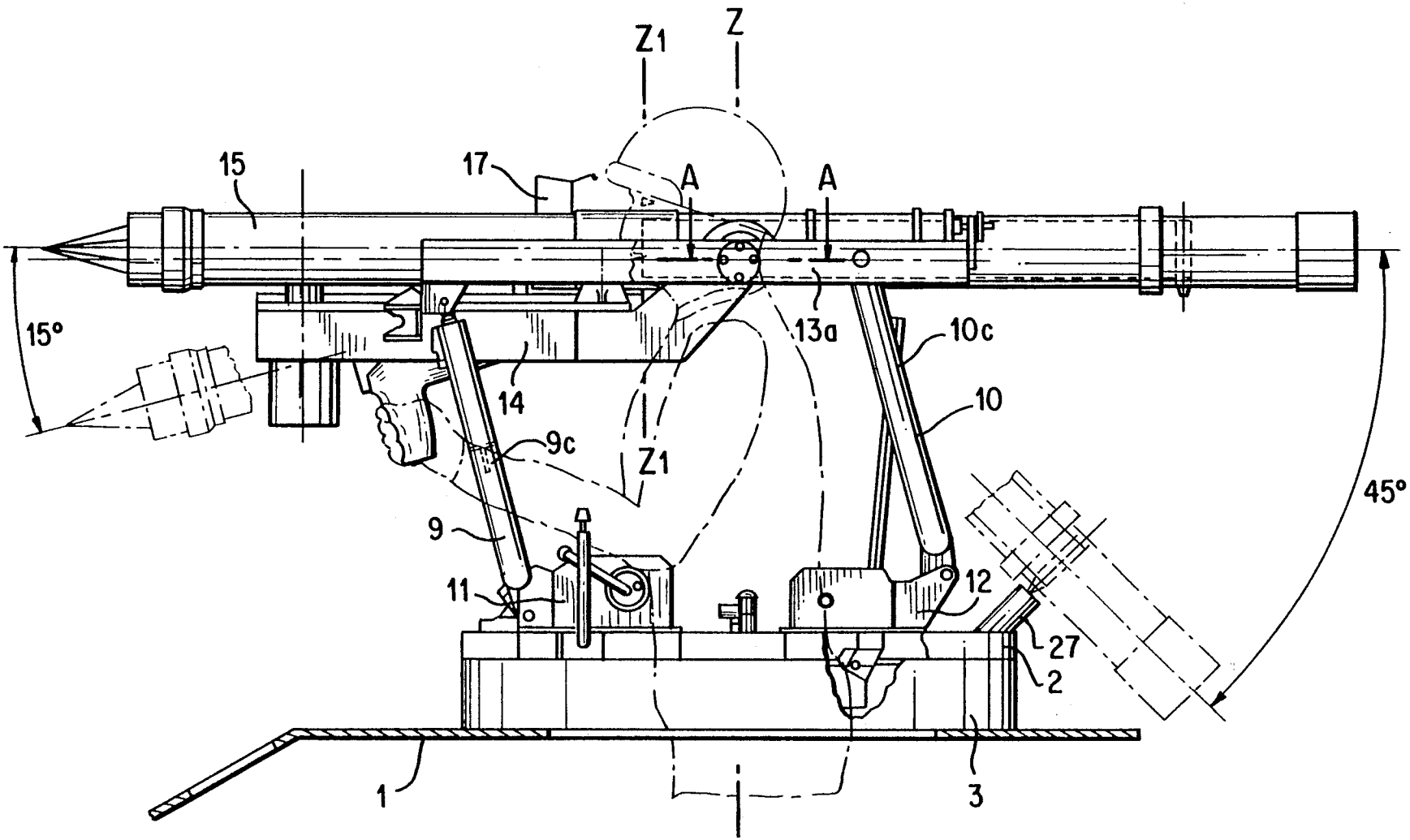
FIG. 1 is a side view of a turret incorporating a trunnion assembly according to the present invention wherein the turret is in its deployed position.

A first mounting member 9 is pivotally attached to the support plate 2 in front of the aximuth axis Z—Z and a second mounting member 10 is pivotally attached to the support plate 2 at a position rearwardly of the azimuth axis Z—Z as illustrated in FIGS. 1 and 2. The forward position of the armored vehicle is illustrated as being toward the left in FIGS. 1 and 2, while the rear of the vehicle is toward the right in these figures.

The first and second mounting members 9 and 10 have a generally "U" shape comprising a base **9*a* and 10*a* with two arms, 9*c*, 9*d*, 10*c* and 10*d* extending from either side of the bases. Base 9*a* is pivotally attached to the support plate 2 via yokes 9*b*, while mounting member base 10*a* is attached to the support plate 2 via mounting yokes 10*b*. The axes about which the first and second mounting members 9 and 10 pivot extend generally parallel to each other and, when the turret is in the forward facing position shown in FIGS. 1 and 2, these axes may extend generally laterally across the vehicle. The yokes 9*b* may be attached to support boxes 11, while yokes 10*b* may be attached to support boxes 12. Support boxes 11 and 12 are fixedly attached to the upper surface of support plate 2 so as to pivotally support each of the mounting members 9 and 10**.

Crossmembers **13*a* and 13*b* interconnect the upper portions of arms 9*c* and 10*c*, as well as upper portions of arms 9*d* and 10*d*, respectively. The crossmembers 13*a* and 13*b* are pivotally attached to the upper portions of each of the respective arms such that the assembled structure is movable as a four-bar linkage between a stowed position, shown in FIG. 2 and a deployed position, shown in FIG. 1. Arms 9*c*, 9*d*, 10*c* and 10*d* may be the same length so that crossmembers 13*a* and 13*b*** are substantially horizontal in both the stowed and deployed positions.

Figure 4:
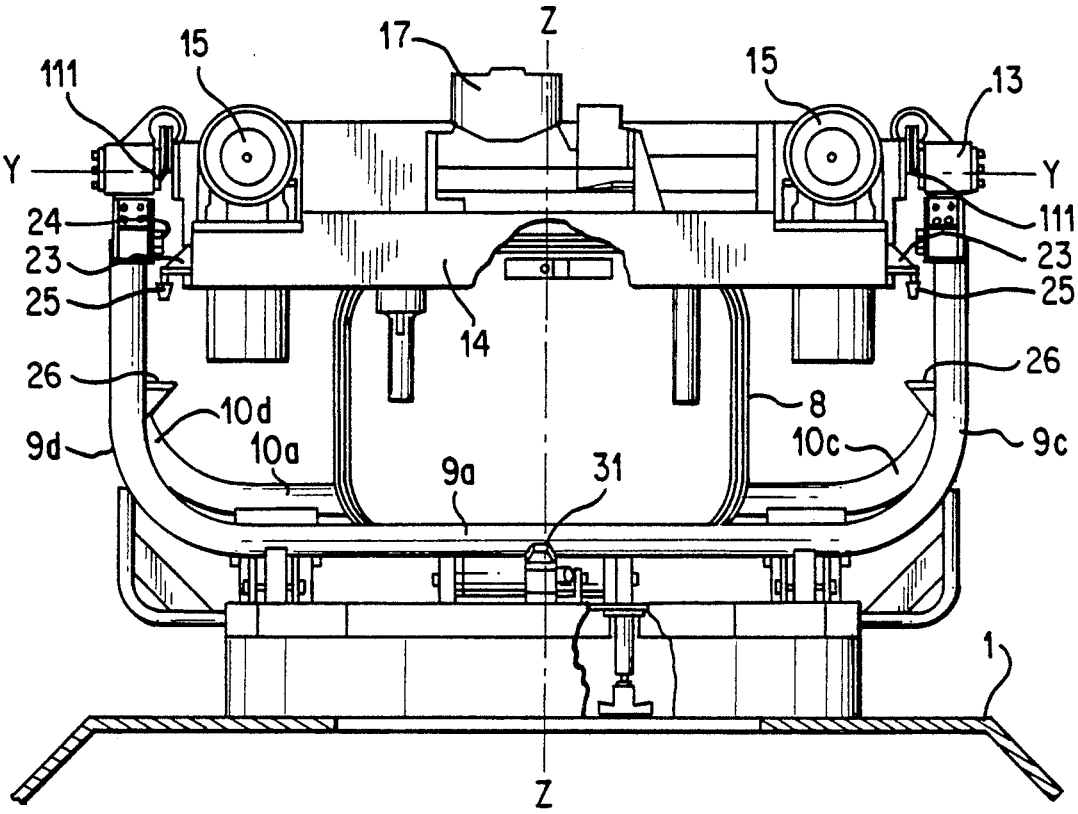
FIG. 4 is a front view of the turret shown in FIGS. 1 and 3 in the deployed position.
Figure 3:
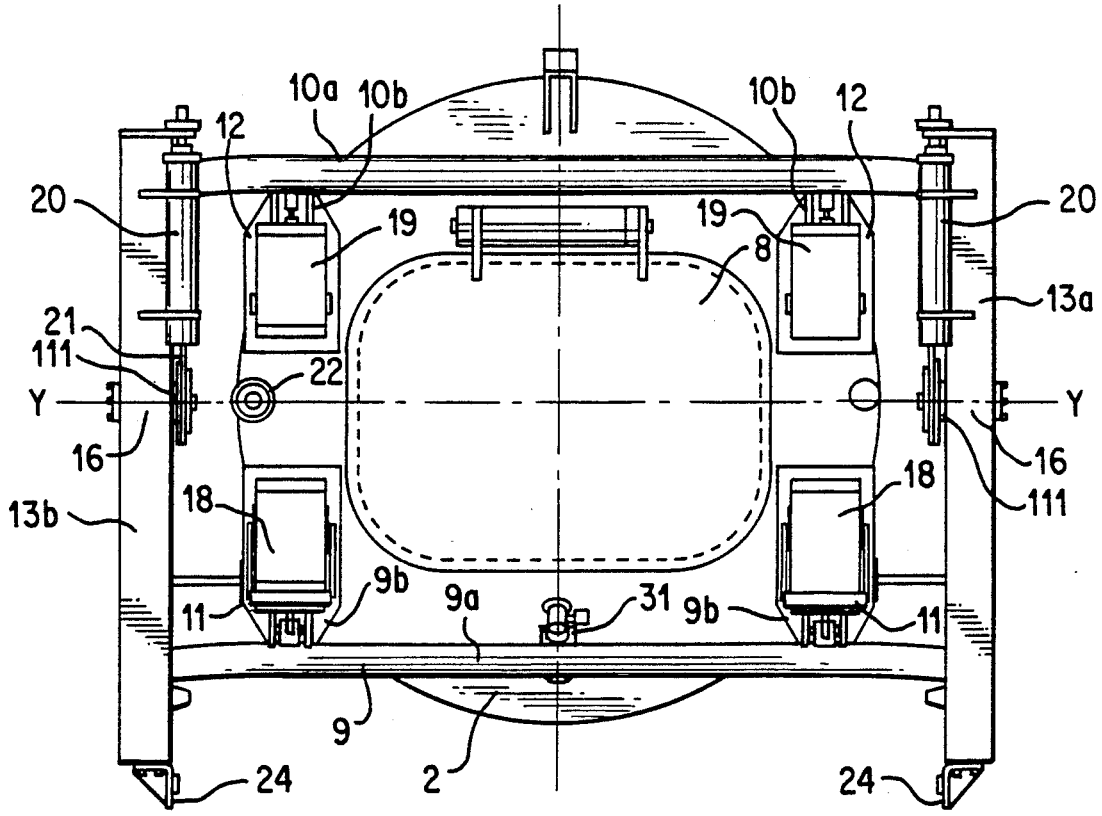
FIG. 3 is a top view of the turret incorporating the trunnion assembly according to the present invention in its deployed position.

Weapons support means 14 is pivotally attached to crossmembers 13*a* and 13*b* so as to pivot about an elevational axis Y—Y, illustrated in FIGS. 3 and 4. Axis Y—Y extends in a generally horizontal direction generally perpendicular to the azimuth axis Z—Z. When the turret is in its deployed position, illustrated in FIGS. 1, 3 and 4, the elevational axis Y—Y and the azimuth axis Z—Z are located in a common, generally vertically extending plane. Bearings 16 are utilized to attach the weapons support means 14 to the crossmembers 13*a* and 13*b*. Weapons support means 14 may support a plurality of weapons 15, which may include machineguns, rockets, or laser powered weapons. In known fashion, a sighting device 17 is located on the weapon support means 14 in front of the operator, as illustrated in FIG. 1.

The center of gravity of the weapon support means 14 is generally located along axis Z1—Z1 which, as illustrated in FIGS. 1 and 2, is in front of the azimuth axis Z—Z in both the stowed and deployed positions. Depending upon the particular weapon utilized, this location may render it difficult for the operator to raise the turret from its stowed to its deployed position. Therefore, means are provided to assist the operator in such movement. The means may comprise deployment actuators 18 and 19 operatively associated between the support plate 2 and the mounting members 9 and 10, respectively. The actuators 18 and 19 may be mounted on support boxes 11 and 12, respectively, and may comprise mechanical actuators of the power cylinder type having an extendable and retractable piston rod. The piston rods may be attached to yokes 9*b* and 10*b*, respectively, such that, as the rods are extended or retracted, pivotal movement is imparted to the first and second mounting members 9 and 10 so as to move the turret between the stowed and deployed positions.

Since the weapon supports means 14 may carry two weapons, such as rockets, the deployment actuators 11 may have means to disengage them in order to balance the forces exerted on the turret when it carries only one weapon.

Elevational actuating means may also be provided to assist the operator in rapidly adjusting the elevational position of the weapon support means 14. The elevational actuating means may comprise mechanical actuator 20 attached to each of the crossmembers 13*a* and 13*b*, respectively. Actuator 20 may, again, comprise a mechanical actuator having an extendable and retractable rod wherein the rod is connected, via cable 21, to a pulley attached to the weapon support means 14 at its elevational axis Y—Y. As the rod of the actuator 20 is extended or retracted, movement of the cable causes the pulley to rotate about axis Y—Y, thereby assisting the operator in adjusting the elevational position of the weapon support means 14.

The turret according to the invention may also incorporate various locking systems. An azimuth locking pin 22 may be located in support plate 2 such that it will lock the support plate 2 in a position wherein the weapons 15 on the weapon support means 14 face the front of the vehicle. Locking pin 22 may, of course, be easily released by the operator to enable the turret to pivot about the aximuth axis Z—Z. In known fashion, the locking pin 22 may be spring biased such that it automatically locks the turret in the forward-facing position the first time the turret passes into this position.

Elevational locking means may also be provided to lock the weapon support means 14 in a generally horizontal position. Latches 23 may be located on either side of the weapon support means 14 and may, in known fashion, engage correspondingly located sears 24 mounted on the crossmembers 13*a* and 13*b*. The elevational locking device may be utilized to lock the weapons in a generally horizontal position when the turret is in its stowed position on top of the vehicle.

Generally speaking, the elevation of the weapon support means 14 and, the weapon 15, is variable between −15° and +45°. Stops 25 may be provided on the weapons support means 14 to limit the downward angle by coming into contact with plates 26 extending from arms 9*c* and 9*d*, respectively. This will prevent damage to the front of the vehicle when the weapon is fired. The upward elevational angle of the weapon support means 14 is limited by stop 27, located on the rear portion of the support plate 2. This stop 27 contacts a stop located on the rear portion of the weapon, as illustrated in FIG. 1.

Figure 5:
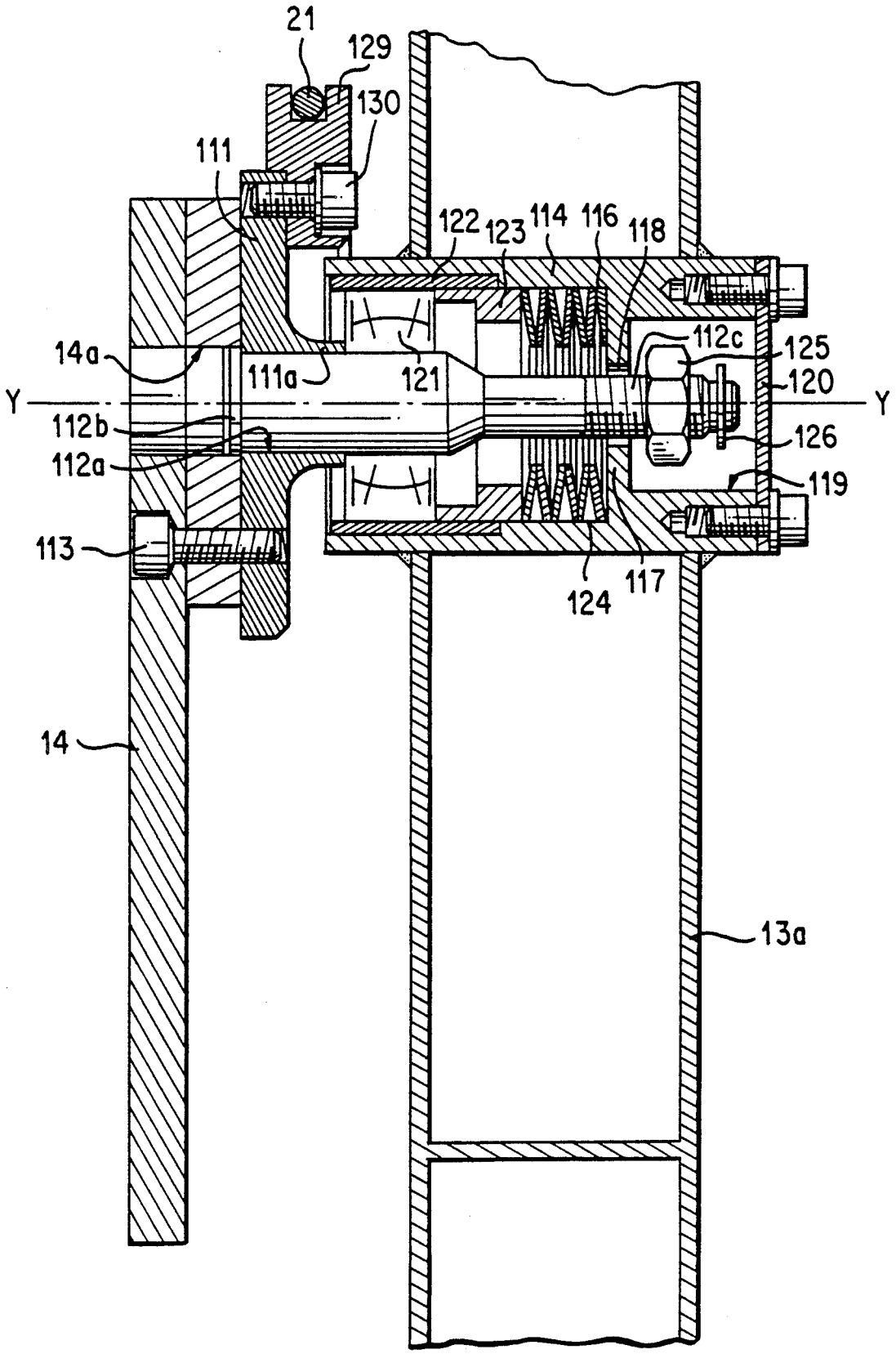
FIG. 5 is a cross-sectional view of a trunnion assembly according to the present invention.

The trunnion assembly used to pivotally support the weapon carrier 14 between the cross-members 13*a* and 13*b* is illustrated in FIG. 5. As can be seen, the trunnion assembly comprises a pivot pin 112 fixedly attached to the weapon carrier 14 via trunnion 111. This attachment may be achieved by screws 113 or the like.

The pivot pin 112 extends into mounting box 114 fixedly attached to cross-member 13*a*. It is to be understood that a similar assembly is mounted on crossmember 13*b*. Mounting box 114 has a laterally extending wall 117 which defines an opening 118 therethrough. A threaded portion 112*c* of pin 112 extends through the opening 118.

A resilient spring 116, illustrated as a stack of spring washers, bears against one side of the wall 117 and urges a spacer member 123 against a race of the bearing 121. Bearing 121 may be any type of anti-friction bearing, such as the type having inner and outer races with roller or ball elements interposed between the races. The inner race, as is well-known in the art, may be fixedly attached to cylindrical portion 112*a* of pin 112. The outer race is slidably mounted within a self-lubricating ring 122 which is, in turn, mounted to the interior of mounting box 114. Spacer member 123 also bears against a side of the outer race such that the force exerted on the race by the spring 116 and the spacer member 123 will tend to urge the bearing assembly 121 and the pin 112 in a first axial direction, toward the left as illustrated in FIG. 5.

Pin 112 may also include a shoulder portion 112*b* to bear against a portion of the trunnion 111. Trunnion 111 has a portion 111*a* that is attached to the cylindrical portion 112*a* of the pivot pin and bears against the inner race of bearing 121.

Although only one trunnion assembly has been described as being attached to cross-member 13*a*, it is to be understood that a similar structure is mounted to opposite cross-member 13*b*. These structures are oriented such that the respective springs bias the pivot pins toward each other and toward the center of the turret. When the pins are both biased to their extreme first positions, there is insufficient distance between the respective trunnions 111 to insert the weapon carrier 14 when assembling the turret. To facilitate this assembly, means are provided to move the pivot pins and their respective trunnions in a second axial direction, generally opposite to the first axial direction. This means comprises a nut 125 threadingly engaged to the threaded portion 112*c* of the pivot pin 112. Nut 125 is prevented from disengagement with the end of the pivot pin via a spring clip 126, or the like. In order to move the pivot pin in the second axial direction nut 125 is threaded onto the pivot pin 112 until it engages a surface of the wall 117. Further rotation of the nut will cause the pivot pin 112 to move in the second axial direction generally opposite to the first axial direction (toward the right as illustrated in FIG. 5). Since portion 111*a* of the trunnion 111 is fixedly attached to the pivot pin 112 and bears against the inner bearing race of bearing 121, movement of the pivot pin also causes movement of the bearing assembly 121 on the self-lubicating ring 122.

When both trunnions have been laterally moved far enough apart to accommodate the insertion of the weapon carrier, they may be selectively moved in the first direction until they engage the sides of the weapon carrier 14 and screws 113 may then be inserted to assemble these elements.

Mounting box 114 may also define cavity 119 in which to accommodate the distal end of threaded portion 112*c*, nut 125 and spring clip 126. A cover 120 may be removably attached to the mounting box 114 to cover the cavity 119.

Once the weapon carrier 14 has been assembled to the respective trunnions 111, nut 125 is rotated in the opposite direction so as to be moved out of contact with the wall 117. The weapon carrier is, thus, laterally supported by opposite acting springs 116 and may move laterally with respect to the cross-members 13*a* and 13*b* to provide a shock absorbing mounting and to also accommodate differences in expansion and contraction between the weapon carrier and the turret. The elastic mounting also permits the self-alignment of the weapon support on the turret and increases the operating flexibility of the assembly. The mounting enables the design tolerances of the turret supports to be increased without deleteriously affecting the operation of the turret.

The cable 21 of actuator 20 may be attached to pulley 129 which is, in turn, attached to trunnion 111 by bolts 130 or the like. Thus, movement of the cable 21 by the actuator 20 will assist the operator in pivoting the weapon carrier 14 about the elevational axis Y—Y.

The foregoing description is provided for illustrative purposes only and should not be construed as in any way limiting this invention, the scope of which is defined solely by the appended claims.

We claim:

1. A trunnion assembly for pivotally supporting a weapon carrier on support member so as to pivot about a pivot axis comprising:

a) a pivot pin having a longitudinal axis defining the pivot axis;

b) a support member;

c) bearing means attached to the pivot pin such that the pivot pin may pivot about the pivot axis;

d) mounting means slidably mounting the bearing means to the support member such that the bearing means is movable along the axis about which the pivot pin pivots;

e) resilient biasing means operatively interposed between the support member and the bearing means to exert a biasing force on the bearing means so as to bias the bearing means and the pivot pin in a first axial direction along the axis about which the pivot pin pivots; and, f) means operatively interposed between the pivot pin and the support member to overcome the biasing force of the resilient biasing means and move the pivot pin and the bearing means in a second axial direction along the axis about which the pivot pin pivots generally opposite to the first axial direction.

2. The trunnion assembly according to claim 1 wherein the mounting means comprises a self-lubricating ring attached to the support member and operatively associated with the bearing means.

3. The trunnion assembly according to claim 1 comprising attachment means to attach the pivot pin to a weapon support member.

4. The trunnion assembly according to claim 3 further comprising:

a) actuator means;

b) means operatively connecting the actuator means to the attachment means to assist in moving the weapon support about the pivot axis.

5. The trunnion assembly according to claim 1 wherein the pivot pin has a threaded portion and wherein the means to overcome the biasing force of the resilient biasing means comprises a nut threaded onto the pivot pin and located such that it may contact the support member such that turning of the nut causes the pivot pin to move in the second axial direction.

6. The trunnion assembly according to claim 5 further comprising means attached to the pivot pin to prevent removal of the nut.

7. The trunnion assembly according to claim 5 further comprising a mounting box attached to the support member, the mounting box defining a cavity into which the treaded portion of the pivot pin extends.

8. The trunnion assembly according to claim 7 further comprising a cover attached to the support member to close the cavity.

9. The trunnion assembly according to claim 1 wherein the resilient biasing means comprises a spring biasing means.

10. The trunnion assembly according to claim 9 further comprises a mounting box attached to the support member in which the bearing means and spring biasing means are located.

11. The trunnion assembly according to claim 10 further comprising a wall extending generally transversely across the mounting box.

12. The trunnion assembly according to claim 11 wherein the spring biasing means is operatively interposed between the wall and the bearing means.

13. The trunnion assembly according to claim 12 further comprising a spacer member operatively interposed between the bearing means and the spring biasing means.

14. The trunnion assembly according to claim 12 wherein the spring biasing means comprises at least one spring washer.

* * * * *

UNITED STATES PATENT AND TRADEMARK OFFICE

CERTIFICATE OF CORRECTION

PATENT NO. : 5,062,347

DATED : Nov. 5, 1991

INVENTOR(S) : ALLAIS et al.

It is certified that error appears in the above-identified patent and that said Letters Patent is hereby corrected as shown below:

Col. 1, line 17, change "tunnion" to "trunnion".

Col. 5, line 14, change "lubicating" to "lubricating".

Signed and Sealed this

Second Day of November, 1993

*Attest:*

Bruce Lehman

BRUCE LEHMAN

*Attesting Officer*

*Commissioner of Patents and Trademarks*